US008397927B2

(12) United States Patent
Krebs

(10) Patent No.: US 8,397,927 B2
(45) Date of Patent: Mar. 19, 2013

(54) BREAK-OPEN VALVE FOR A CONTAINER

(75) Inventor: Daniel Krebs, Uetendorf (CH)

(73) Assignee: Laboratoires Thea, Clermont Ferrand (FR)

( * ) Notice: Subject to any disclaimer, the term of this patent is extended or adjusted under 35 U.S.C. 154(b) by 1197 days.

(21) Appl. No.: 12/064,437

(22) PCT Filed: Aug. 25, 2005

(86) PCT No.: PCT/CH2005/000496

§ 371 (c)(1),
(2), (4) Date: Jul. 8, 2008

(87) PCT Pub. No.: WO2007/022646

PCT Pub. Date: Mar. 1, 2007

(65) Prior Publication Data

US 2009/0114651 A1 May 7, 2009

(51) Int. Cl.

| | |
|---|---|
| ***B65D 41/00*** | (2006.01) |
| ***B65D 1/02*** | (2006.01) |
| ***B65D 51/16*** | (2006.01) |
| *B67D 3/00* | (2006.01) |
| *B67D 1/00* | (2006.01) |

(52) U.S. Cl. ..... 215/313; 215/48; 215/308; 222/520; 222/153.06

(58) Field of Classification Search ..... 215/47, 215/48, 313, 308, 252, 11.1; 220/277, 278, 220/214, 202, 258.3, 258.4; 222/153.06, 222/153.14, 541.6, 541.1, 153.09, 422, 189.07, 222/189.11, 519, 520, 548, 549; 604/264; 137/68.19, 68.16; 422/558, 537

See application file for complete search history.

(56) References Cited

U.S. PATENT DOCUMENTS

| | | | | |
|---|---|---|---|---|
| 4,134,511 | A | 1/1979 | Deussen | |
| 4,527,700 | A | 7/1985 | Jupin et al. | |
| 4,620,638 | A * | 11/1986 | Schmidt | 215/11.1 |
| 4,773,548 | A | 9/1988 | Deussen | |
| 5,094,361 | A | 3/1992 | Dubach et al. | |
| 5,178,838 | A | 1/1993 | Sala et al. | |
| 5,255,804 | A | 10/1993 | Butterbrodt | |

(Continued)

FOREIGN PATENT DOCUMENTS

| | | |
|---|---|---|
| DE | G 94 04 753.7 | 7/1994 |
| EP | 1 382 540 | 1/2004 |

(Continued)

OTHER PUBLICATIONS

International Search Report issued in corresponding International Application No. PCT/CH2005/000496 dated Jun. 7, 2006.

(Continued)

*Primary Examiner* — Robin Hylton

(57) ABSTRACT

The break-open valve (1) for a container (21) comprises a break-away element (4) which can be twisted off by turning an activator (3). The valve (1) can be used for hermetically sealing a container (21) until its first opening and also for making it tamper-evident. The activator (3) is rotatably affixed to the valve head (2). The activator (3) comprises an inserted disk (16) with at least one opening (10) and a socket (5) which engages the break-away element (4). The activator (3) further comprises a membrane (17) which protects the contents within the activator (3) from contaminants entering through spout (18). The valve (1) has the advantage that it is cost efficient in its production, that it is easy to use and that it is suitable for dispensing sterile contents in more than one dose.

27 Claims, 6 Drawing Sheets

U.S. PATENT DOCUMENTS

| | | | | |
|---|---|---|---|---|
| 5,425,920 | A | 6/1995 | Conti et al. | |
| 5,601,199 | A * | 2/1997 | Marty | 215/11.1 |
| 5,992,692 | A | 11/1999 | Boissay | |
| 6,244,433 | B1 | 6/2001 | Vieu | |
| 6,305,579 | B1 | 10/2001 | Long, Jr. | |
| 6,321,947 | B2 | 11/2001 | Gross et al. | |
| 2004/0011697 | A1 | 1/2004 | Fontana | |
| 2004/0074925 | A1 | 4/2004 | Faurie | |
| 2004/0178162 | A1 * | 9/2004 | Zucker-Franklin | 215/11.1 |
| 2005/0045579 | A1 | 3/2005 | Weiler et al. | |

FOREIGN PATENT DOCUMENTS

| | | |
|---|---|---|
| EP | 1382540 | 1/2004 |
| ES | 1 027 962 | 3/1994 |
| FR | 2546484 | 11/1985 |
| FR | 2687640 | 8/1993 |
| FR | 2 716 389 | 8/1995 |
| FR | 2729924 | 8/1996 |
| FR | 2789372 | 8/2000 |
| IT | MI 94U/00121 | 2/1994 |
| WO | WO02/38464 | 5/2002 |
| WO | WO2004/043816 A1 | 5/2004 |

OTHER PUBLICATIONS

Written Opinion issued in corresponding International Application No. PCT/CH2005/000496 dated Jun. 7, 2006.

Opposition to a European Patent-EP 1 917 195 mailed Jan. 19, 2011.

* cited by examiner

BREAK-OPEN VALVE FOR A CONTAINER

TECHNICAL FIELD

The invention relates to a break-open valve for a container according to the preamble of the independent claims.

BACKGROUND ART

Valves of this kind can be used for containers, in order to securely close them before contents are taken from them for the first time. Such containers can in particular be used for contents such as pharmaceutical or cosmetic products. Securely closing a container until the first use is especially important in the case of liquids which have to be sterile, as for example eye-drops. In the present document the term 'contents' is used as a general term for whatever may pass through the valve and is to be understood to cover substances of all kinds, in particular liquids, pastes, ointments and gases.

It is known to provide containers with a break-away element (e.g. a twist-off pin), which must be broken away to create an opening for dispensing the contents. In most cases, the cap of such containers is provided with a socket, such that it can be used as a tool for twisting off the break-away element. A container of this kind is for example disclosed in U.S. Pat. No. 4,688,703. However, this solution has the disadvantage that the closure can be difficult to use, that the spout may get contaminated during the opening and that there falls off a waste particle, namely the break-away element, during the opening.

It is further known to provide containers with a break-away element, but, in contrast to the solution described above, to permanently affix the tool for breaking-away said element to the container. This has the advantage that the tool is already mounted, which makes the container easier to use and reduces contamination during the opening procedure. In the present document, such a permanently affixed tool is denominated by the term "activator". The procedure of opening such a valve for the first time is called "activation".

A container of this kind, i.e. with such an activator, is described in U.S. Pat. No. 5,425,920. A vial is provided with a breakable diaphragm which has an appendix. A hollow element functions as a tool for turning the appendix and thereby breaking the diaphragm. During the dispensing the contents pass through the hollow element, which remains after the activation, i.e. first opening, affixed to the container.

However, the solution of U.S. Pat. No. 5,425,920 has the disadvantage that its production might be unnecessarily costly and that the break-away element might not be perfectly guided during the breaking process. The latter may result in a breaking which is not precise and/or which produces shavings contaminating the contents. In addition, the force to be applied by a person during an activation of the valve cannot be perfectly predetermined and may vary arbitrarily from valve to valve.

The solution of U.S. Pat. No. 5,425,920 has further the disadvantage that it is not well suited for dispensing sterile contents in more than one dose. The mechanism for reclosing it is not suited for such an application. The break-away element (appendix) is pushed back into the opening created during the activation. However, the contents which already passed said opening remain within the activator (hollow element) where they are exposed to air and other contaminants entering through the spout.

DISCLOSURE OF THE INVENTION

In consideration of the background art described above, it is a general object of a first invention to provide a valve for a container of the kind mentioned at the outset which guides the break-away element in a more precise manner, while being cost efficient in its production.

Now, in order to implement these and still further objects of the first invention, which will become more readily apparent as the description proceeds, the break-open valve is manifested by the features of claim 1, namely by providing the valve with an activator comprising a wall element and a socket element, wherein the socket element is inserted into the wall element and comprises a socket which engages with the break-away element.

This solution has the advantage that the socket, now being formed by a separate element, can be produced with a material and process specifically optimized for its function, while the wall element of the activator can be produced with a different material and process. The valve can therefore be produced more cost efficiently. Further it is possible to make the socket more stable and precise. This improves the activation behavior and makes the valve easier to use.

In an other aspect of this invention the socket element has substantially the shape of a disk. This shape has the advantage that inserting the socket element into the wall element can be done without having to rotationally align it.

In yet an other aspect of this invention the socket element has a diameter which is at least twice as large as the diameter of the socket. A larger diameter has the advantage to provide leverage and accordingly less force must be transmitted between the wall element and the socket element.

In yet an other aspect of this invention the socket element is made harder than the wall element. This has the advantage that the socket element engages more securely with the wall element, as well as with the break-away element.

In yet an other aspect of this invention the activator comprises a passage which allows contents to pass through the activator without passing through the socket. This has the advantage that after activation the break-away element can stay in the socket without interfering with contents passing through the activator, even if the socket matches the break-away element in a way that there is no clearance between the socket and the break-away element.

In consideration of the background art described above, it is a general object of a second invention to provide a valve for a container of the kind mentioned at the outset which is suitable for dispensing in a temporarily distributed manner several doses of contents which must be kept sterile and which are sensitive to contamination.

Now, in order to implement these and still further objects of the second invention, which will become more readily apparent as the description proceeds, the break-open valve is manifested by the features of claim 8, namely by providing the activator with a membrane, which is arranged such that contents passing through the opening created during the activation must first pass through the membrane before they can leave the activator through a spout.

This solution has the advantage that, after the valve is activated, the amount of contents which are directly exposed to contaminants entering through the spout, such as air, is reduced. In particular the contents in the range of the break-away element are behind the membrane. This is especially important, since in this range there are numerous surfaces and cavities where contents may remain and possibly deteriorate after a dispensing. The valve with membrane is therefore well suited to be used for dispensing more than one dose of sterile and sensitive contents.

In an other aspect of this invention the hollow space formed by the activator between the membrane and a spout has a volume of less than 0.1 ml. This has the advantage that the contents which are directly exposed to contaminants entering through the spout and which might possibly deteriorate are limited to an amount which is in most applications unlikely to be harmful.

BRIEF DESCRIPTION OF THE DRAWINGS

The invention will be better understood and objects other than those set forth above will become apparent when consideration is given to the following detailed description thereof. Such description makes reference to the annexed drawings, wherein.

MODES FOR CARRYING OUT THE INVENTION

Figure 1:
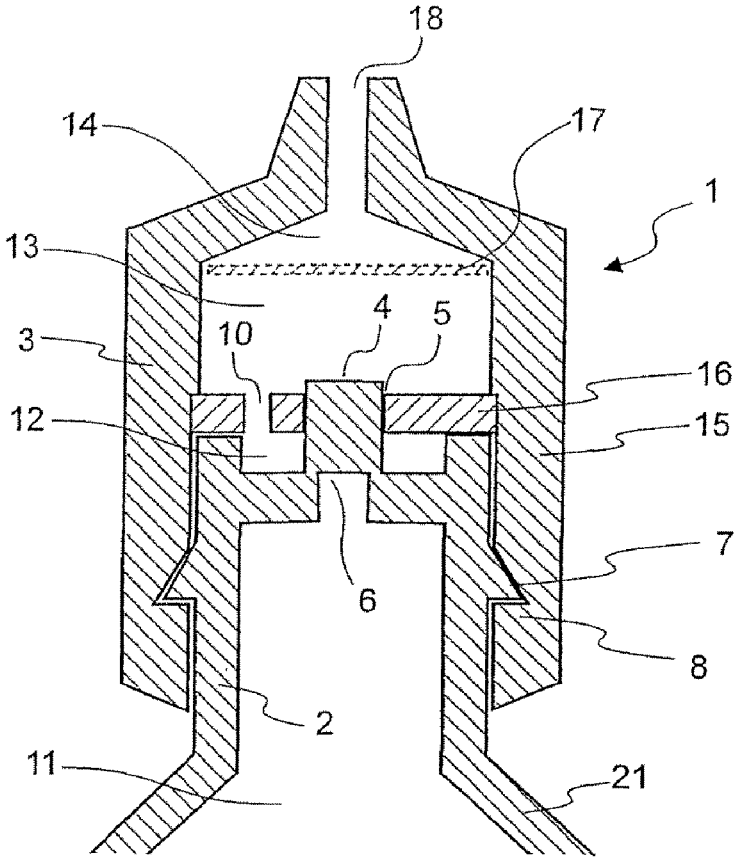
FIG. 1 is a schematic diagram of an exemplary embodiment of the valve according to the first as well as according to the second invention.

FIG. 1 is a schematic diagram of an exemplary embodiment of the valve 1 according to the first as well as the second invention before it was activated, i.e. opened, by twisting off the break-away element 4. The valve 1 comprises a valve head 2 and an activator 3. The valve head 2 is substantially cylindrical. The valve head 2 comprises the break-away element 4 which is connected to it by a predetermined breaking-line 6. The valve head 2 can be part of a container 21, for example a flexible bottle or a tube. However, it can also be a separate element to be screwed or otherwise affixed to a separately manufactured container. The activator 3 comprises a wall element 15 and, inserted into the wall element 15, a socket element 16 and further a membrane 17. Instead of the term "wall element" also the term "housing element" or "shaft element" can be used. The activator 3 comprises a cylindrical portion which fits over the valve head 2, such that the activator 3 can be rotated relatively to the valve head 2. The activator 3 is held on the valve head 2 by snap-on means 7, 8. The activator 3 is rotatably affixed to the valve head 2, i.e. it can be rotated, but during normal use not be pulled off the valve head 2. An example for "normal use" is activating the valve by hand for dispensing contents. An example for "not normal use" is disassembling the valve for recycling purposes by applying extraordinary forces by hand or by using a tool. The activator 3 is mounted on the valve head 2 during the production of the valve 1 and then remains there during the entire life cycle of the product. Preferably the snap-on means are designed such that the mounting is easier than the dismounting. The force necessary for dismounting of the activator 3 is preferably much larger than the force which has to be applied tangentially to the circumference of the activator 3 for activating the valve. At its distal end, the activator 3 forms a spout 18 through which the contents are dispensed. Preferably the activator 3 is designed in a color different from the container 21, in particular in a well noticeable color, for example yellow, such it can be easily seen by a user where to manually rotate for the activation of the valve 1.

The socket element 16 is an element separate from the wall element 15. It has substantially the shape of a disk. However, it can also have other shapes, as for example the shape of a triangle, square or other polygon. The socket element 16 is inserted into the wall element 15 before the activator 3 is mounted onto the valve head 2. This has the advantage, that the socket element 16 can be produced from a different material and with a different process than the wall element 15 of the activator 3. The socket element 16 is preferably made from a material which is harder that the material of the wall element 15 of the activator 3. In the center of socket element 16 is the socket 5, which engages with the break-away element 4 in a way that a rotational force can be transferred. The diameter of the socket element 16 is preferably at least twice the diameter of the socket 5. The outer diameter of the socket element 16 and the inner diameter of the wall element 15 are adapted to each other such that the socket element 16 can be affixed inside of the wall element 15 simply by pressing one element into the other. In the shown state before the activation contents cannot exit the container, in particular they cannot pass from hollow space 11 to hollow space 12, 13 and 14. The other way around, air cannot pass from the outside through hollow space 14, 13 and 12 into hollow space 11. In the socket element 16, there is preferably at least one opening 10 between the socket 5 and the edge of the socket element 16, which forms a passage, such that during dispensing the contents do not have to pass through the socket 5.

Figure 2:
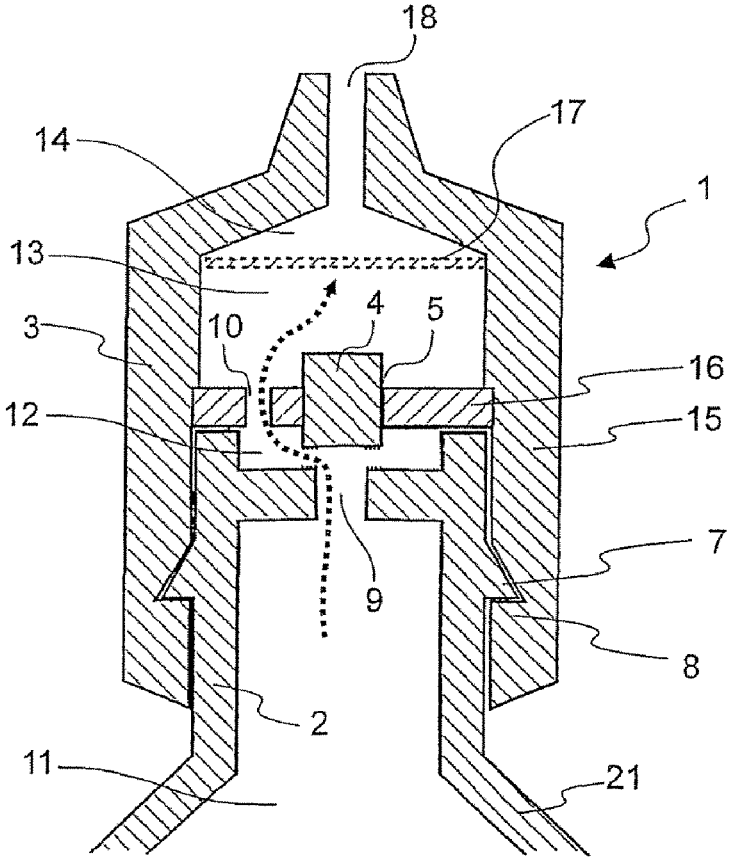
FIG. 2 is a schematic diagram of the valve of FIG. 1 after its activation.

FIG. 2 is a sectional view of the valve of FIG. 1 after it was activated. The break-away element 4 was twisted off by rotating the activator 3 relatively to the valve head 2. By doing so an opening 9 was created. The contents can now pass from the hollow space 11 through opening 9 into hollow space 12, from there through opening 10 into hollow space 13, then through membrane 17 to hollow space 14 and finally through spout 18 to the outside. The elements holding the membrane 17 are not shown. The break-away element 4 remains in the socket 5. However, once liquid is being dispensed it may be pushed slightly in an axial direction away from the opening 9. Due to the opening 10 there is no need for the contents to pass through socket 5 and the break-away element 4 can therefore remain in the socket after the activation and during dispensing. This has the advantage that there is no loose particle the clatter of which may be interpreted as a malfunction and may disturb during dispensing.

The membrane 17 is arranged such that the contents being dispensed must pass the membrane 17 substantially directly before exiting the valve through spout 18. Preferably the membrane 17 is arranged as close as possible to spout 18 such that hollow space 14 has a minimized volume. The volume of hollow space 14 is preferably less than 0.1 ml, in particular less than 0.05 ml or less than 0.02 ml. When dispensing all contents at once, contamination is no problem, since, until the valve is activated, the contents are hermetically sealed in hollow space 11. However, if the valve is activated and only part of the contents are dispensed, the remaining contents are exposed to contaminants entering through spout 18. The membrane 17 protects the contents against such contamination. Only the very small amount of contents in hollow space 14, which already passed the membrane 17 are exposed. The valve is therefore suitable for dispensing more than one dose of contents sensitive to contamination in a timely distributed manner. The diameter of the membrane 17 is preferably chosen as large as possible within the given outside maximum dimensions of the valve such that the contents can pass without applying much pressure. The diameter is therefore preferably substantially as large as the inner diameter of the wall element 15.

Figure 3:
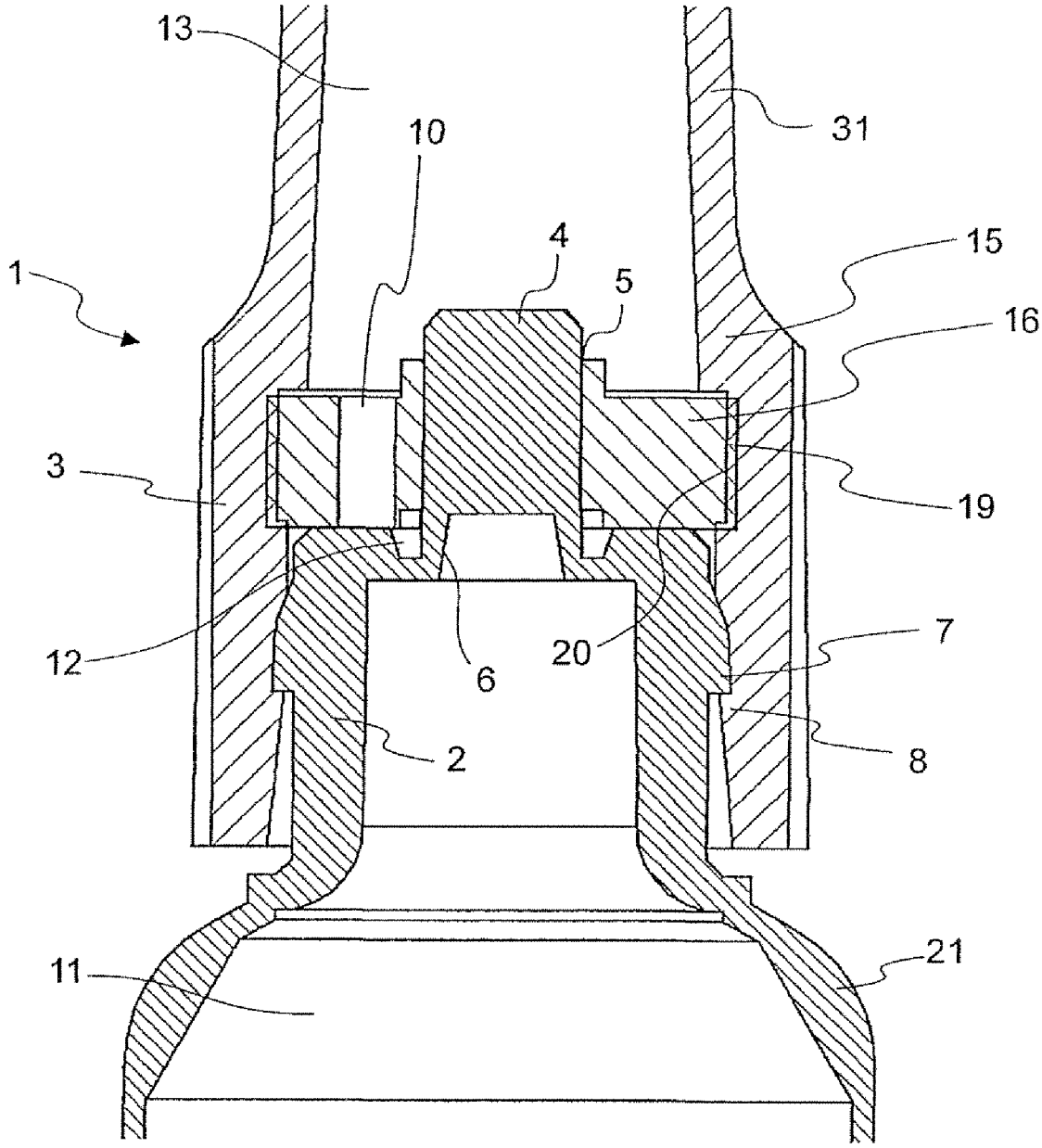
FIG. 3 is a sectional view of a preferred embodiment of the valve according to the first invention.

FIG. 3 shows a preferred embodiment of the valve 1 according to the first invention. The valve 1 is shown in the state before its activation. The valve 1 is used as a dispensing head for a container 21. The container 21 is preferably a tube. The activator 3 comprises a cannula 31. Such a container 21 with break-open valve and cannula can for example be used for rectal ointments. To activate the valve 1, the activator 3 is turned relatively to container 21. The activator 3 comprises a socket element 16 with a socket 5 in its center and with at least one opening 10, preferably three openings 10, through which the contents can pass in order to bypass the socket 5 which holds the break-away element 4. Properties, functions and variations of the socket element 16 described referring to FIG. 1 can be here applied accordingly. In the shown embodiment the diameter of the socket element 16 is about three times the diameter of the socket 5. The diameter of the container 21 is preferably between 10 mm and 20 mm, in particular 16 mm. The diameter of the activator 3 is preferably slightly smaller, preferably between 8 mm and 15 mm, in particular 10.7 mm.

When the tube with dispenser is produced, in a first step the three parts—tube with valve head 2, socket element 16 and wall element 15 with cannula 31—are produced separately. In a second step the socket element 16 is pressed into the wall element 15. In a third step the wall element 15 with socket element 16, i.e. the activator 3, is snapped onto, the valve head 2. The socket element 16 may comprise a knurling 19, and the activator 3 a corresponding knurling 20. The valve head 2 comprises snap-on means 7, and the activator 3 corresponding snap-on means 8, for example noses engaging with a rim or a rim engaging with an other rim. The container 21 with valve 1 may further comprise a cap (not shown) which is designed to fit over the cannula 31 such that it covers the openings in the cannula 31.

Figure 4:
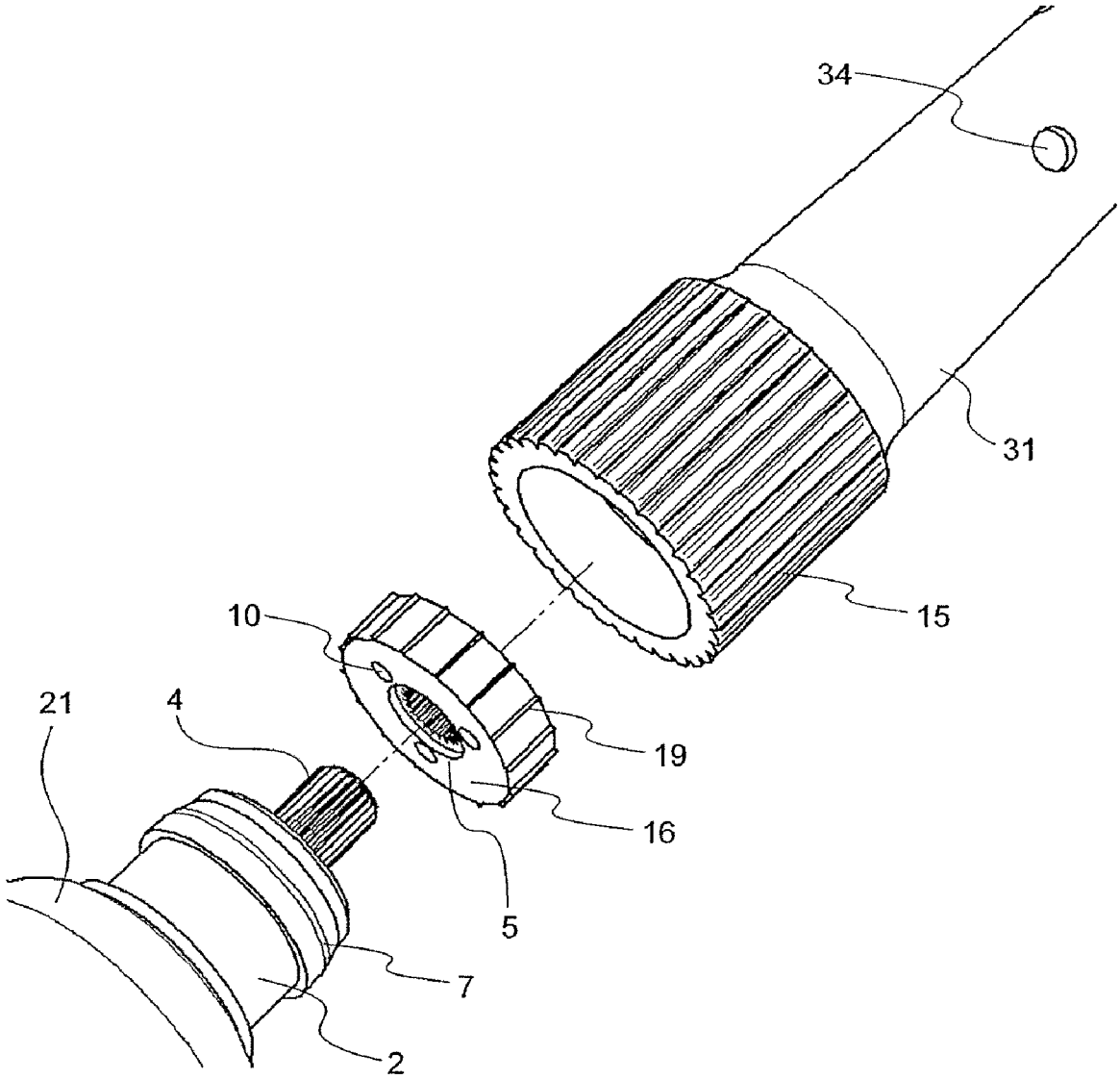
FIG. 4 is an exploded three dimensional view of the valve of FIG. 3.

FIG. 4 shows the valve of FIG. 3 in an exploded three dimensional view. The container 21 comprises a valve head 2 with a rim serving as a snap-on means 7. On the valve head 2 there is the break-away element 4. The break-away element 4 is a twist-off pin. It has a substantially cylindrical shape with a knurling. In the socket 5 of the socket element 16 there is a matching knurling. The socket element 16 comprises three openings 10, which are distributed around the socket 5 in an evenly spaced manner. The number of openings 10 can be varied, preferably in the range of one to ten. The circumferential surface of socket element 16 comprises also a knurling 19, i.e. axial ribs. Wall element 15 can be provided with notches which these ribs engage with. Cannula 31 has lateral openings 34. As already mentioned, during assembly of the container 21 with valve 1, first the socket element 16 is inserted into the cannula 31. Afterwards the activator 3 is snapped-onto the valve-head 2.

Figure 5:
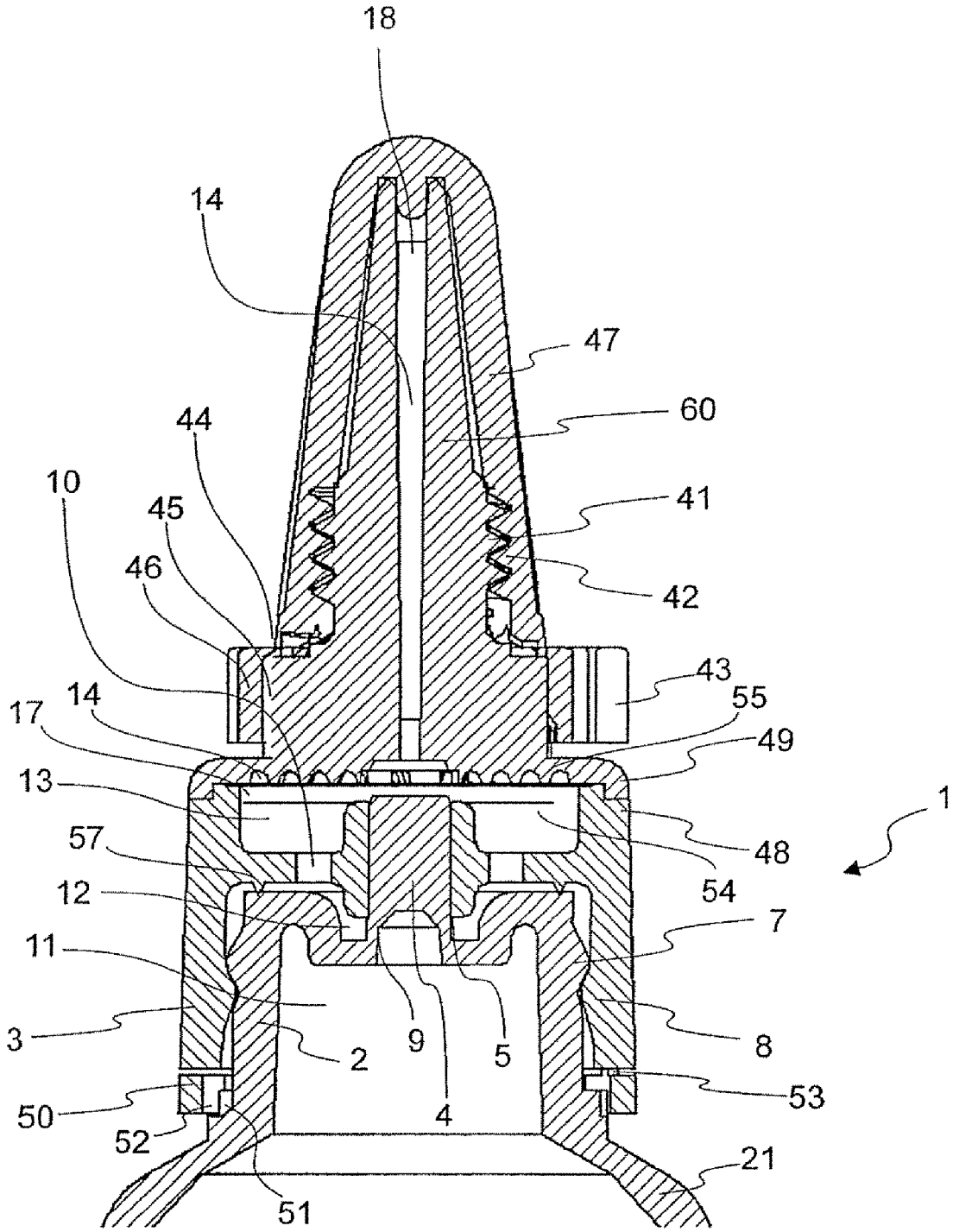
FIG. 5 is a sectional view of a preferred embodiment of the valve according to the second invention.

FIG. 5 shows a preferred embodiment of the valve 1 according to the second invention. The valve 1 comprises a membrane 17, a cannula 60 and a cap 47. The valve 1 is used as a dispensing head for a container 21, in particular a tube or flexible bottle. It is especially suitable for an ophthalmic application, i.e. for storing and dispensing eye-drops. After activating the valve 1 by turning the activator 3 liquid can pass from hollow space 11 through the newly created opening in the valve head 2 into hollow space 12, through openings 10 into hollow space 13, through the membrane 17 into hollow space 14 and finally through spout 18. Hollow space 14 comprises the notches of membrane holder 55 and the delivery passage inside of the cannula 60. The volume of hollow space 14 is preferably as small as possible, in particular less than 0.1 ml, 0.05 ml or 0.02 ml. Accordingly unnecessary cavities in hollow space 14 are avoided. The amount of liquid which might deteriorate due to air contact is thereby minimized. The diameter of the container 21 is preferably between 15 mm and 25 mm, in particular 19 mm or 22 mm. The diameter of the activator 3 is preferably slightly smaller, preferably between 10 mm and 20 mm, in particular 14 mm. The diameter of the membrane 17 is preferably 3 mm to 5 mm, in particular 4 mm, less than the diameter of the activator 3. The cannula 60 is preferably designed for drop-wise dispensing. Its inner diameter increases towards its distal end, in particular from 0.6 mm near the membrane to 0.9 mm at the spout, which reduces the speed of the liquid towards spout 18.

The membrane 17 is preferably semi-permeable and/or hydrophobic. In particular it comprises silver ions such that it is antibacterial. It can for example be a GoreTex® material. Properties, functions and variations of the membrane 17 described referring to FIG. 2 can here be applied accordingly. The dispensing head with membrane can in particular be used for an "airless system", i.e. a tube where the space resulting from removing contents is not filled with air. Instead, air is substantially prevented from entering the tube and the dispensed volume is compensated by a deformation of the container 21.

The activator 3 comprises a first part 48 and a second part 49. The membrane 17 is held between these two parts 48, 49, in particular by membrane holders 54 and 55. These holders 54, 55 preferably comprise radial and/or annular notches and/or bars, such that the liquid can pass evenly distributed through the membrane 17 using substantially all portions of it. In the shown embodiment holder 55 comprises five annular notches and six radial notches. Membrane holder 54 comprises six radial bars. The activator 3 is held on the valve head 2 by snap-on means 7, 8.

The activator 3 comprises further a sealing band 50. The sealing band 50 is at the end of the activator 3 which is next to the container. It is connected to the activator body by bars 53 which function as predetermined breaking points. The valve head 2 comprises teeth 51 and the sealing band 50 comprises teeth 52. The teeth 51, 52 are arranged and designed such that they do not interfere with the mounting of the activator 3 in an axial direction, but do interfere with a rotation of the mounted activator 3 such that the activator 3 can only be rotated freely after at least some of the predetermined breaking points have been broken. This further improves the tamper-evidence of the closure. There is already a certain tamper-evidence due to the break-away element. Since the break-away element is integrated in valve it is not possible to visually check, if the element was broken away. However, it can be checked by trying to dispense and also by turning the activator. Once the element is broken away there is less resistance. The sealing band 50 allows to check visually whether the valve was tampered with and possibly activated. The activator 3 comprises further an annulus 57. The annulus 57 is in force contact with the valve head 2. It functions as a gasket and assures that the hollow space 12 is, apart from openings 10 and, as the case may be, 9, hermetically sealed.

The break-away element 4 and the socket 5 preferably comprise knurlings matching each other. The break-away element 4 is partially countersunk in respect to the valve head 2, i.e. when looking at the valve from the side, there is an overlap between the break-away element and the valve head. To countersink the break-away element has the advantage that the valve can be designed shorter, which makes it more compact, saves material and reduces the volume of the passage through the valve. As shown in the figure, the socket 5 can be designed such that it extends in axial direction covering substantially the whole length of break-away element 4. Accordingly, when the break-away element 4 is countersunk, part of the socket 5 extends into the valve-head 2.

The cap 47 is preferably a screw-on cap. The cannula 60 comprises a thread 41 and the cap 47 a matching thread 42. The cap 47 further comprises a sealing band 43 with ratchet teeth 46. The activator 3 comprises matching ratchet teeth 45. The teeth 45, 46 are arranged and designed such that the cap 47 can be screwed onto the activator 3 together with the sealing band 43, but can only be screwed off after or by breaking the sealing band at least partially from the cap body, in particular at predetermined breaking points 44.

Figure 6:
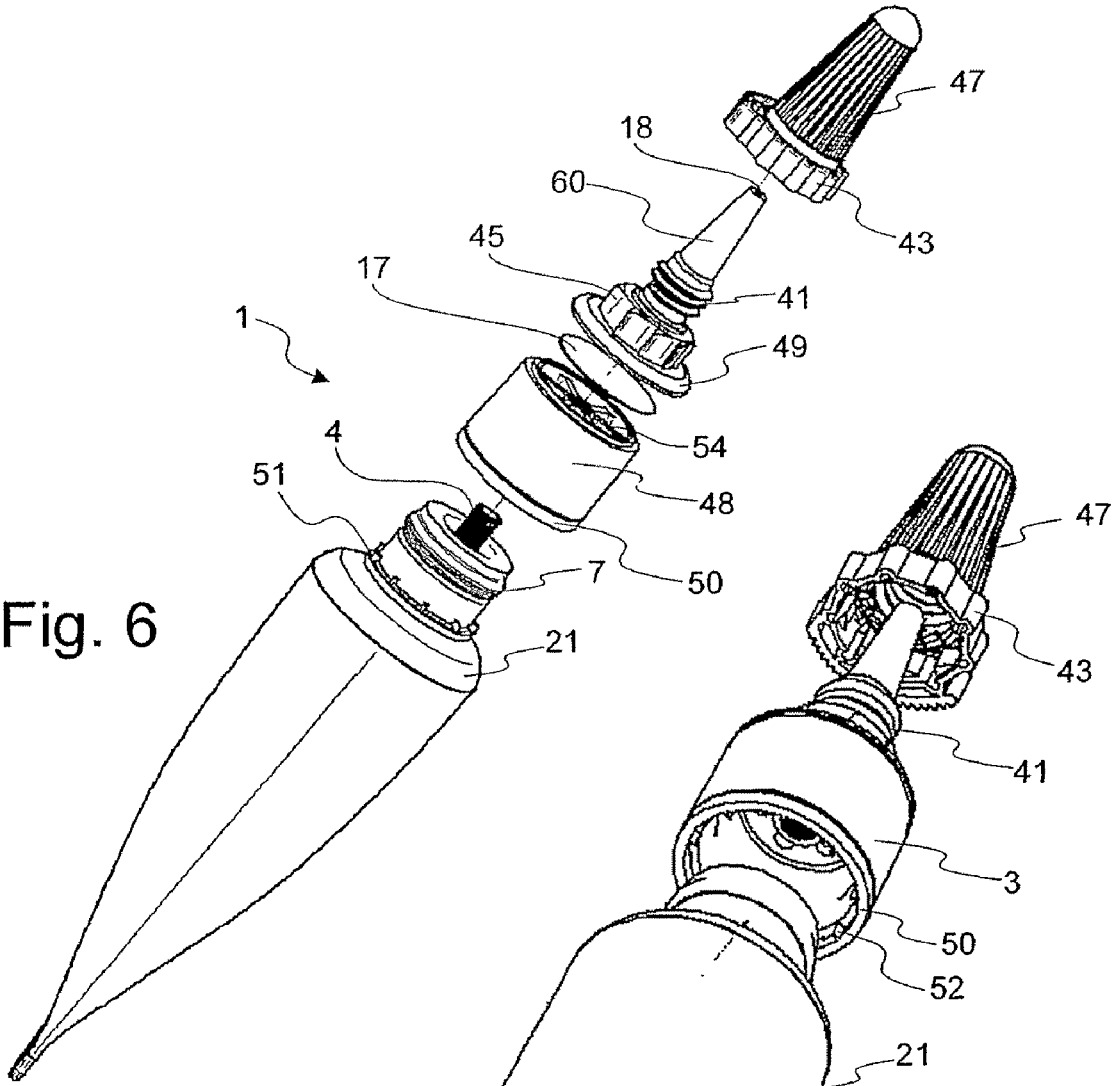
FIG. 6 is an exploded three dimensional view of the valve of FIG. 5.

FIG. 6 shows the embodiment of FIG. 5 in an exploded three dimensional view. Container 21, activator part 48, membrane 17, activator part 49 and cap 47 are shown as separate elements as they are before the container with valve is assembled.

Figure 7:
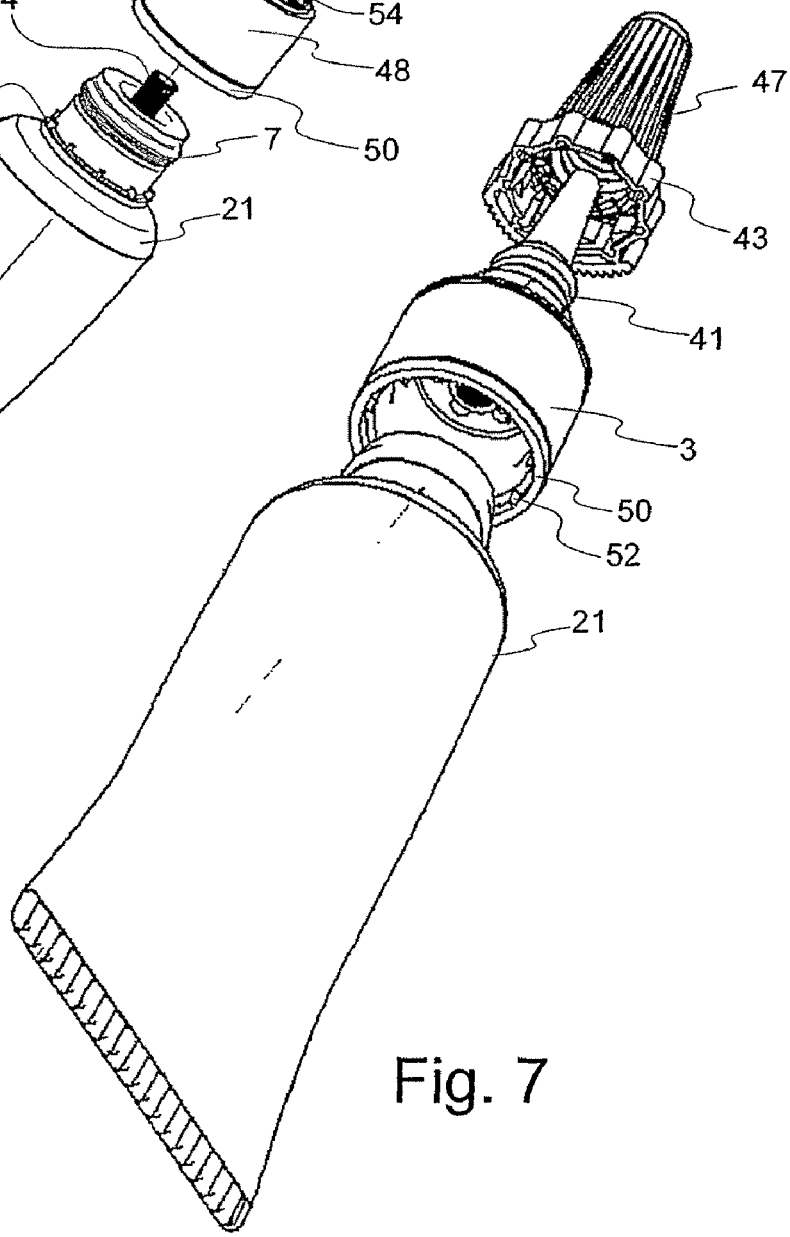
FIG. 7 is a further exploded three dimensional view of the valve of FIG. 5.

FIG. 7 shows the embodiment of FIG. 5 in a further exploded three dimensional view. This view differs from the one of FIG. 6 in that the activator 3 is assembled, while container 21, activator 3 and cap 47 are still shown as separate elements.

Figure 8:
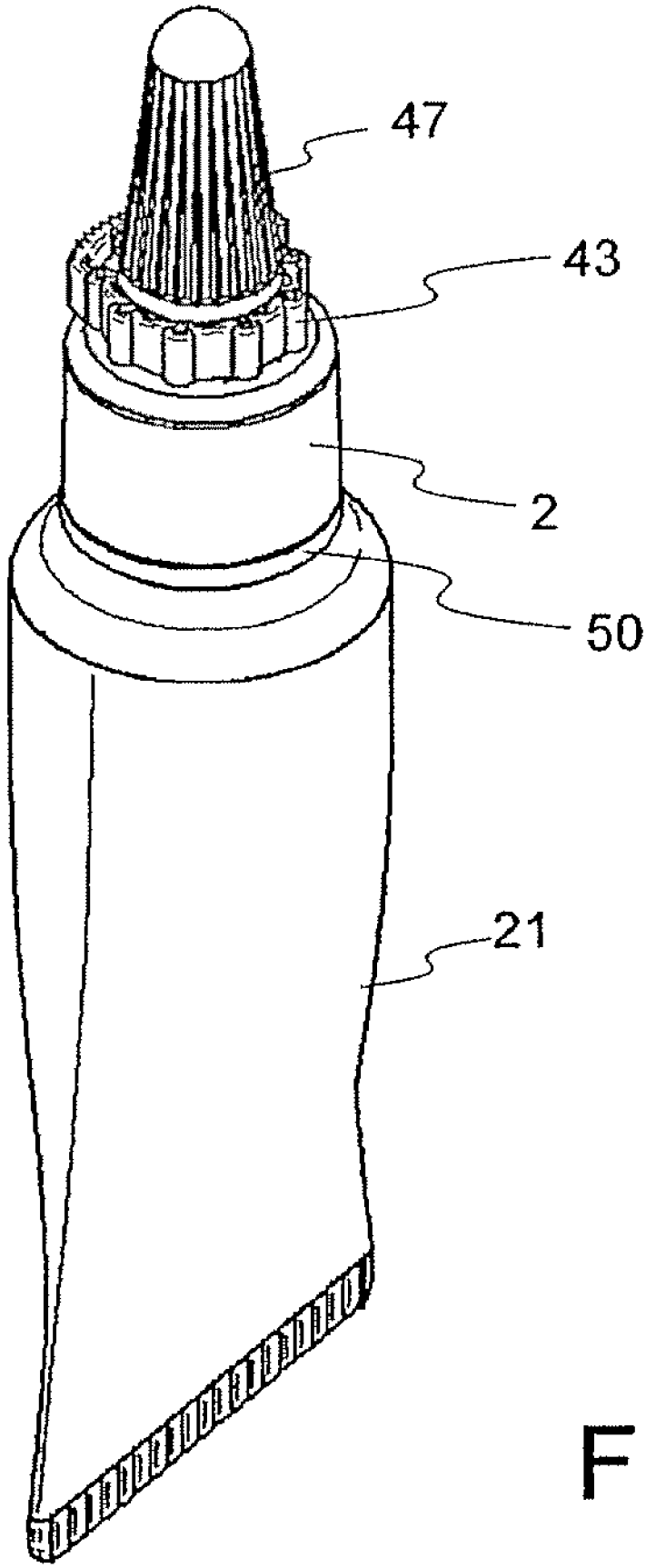
FIG. 8 is a three dimensional view of the valve of FIG. 5.

FIG. 8 shows the embodiment of FIG. 5 in a three dimensional view. This view differs from the one in FIGS. 6 and 7 in that all elements of the container with valve are assembled.

Referring to the figures substantially three different embodiments are described. However, features and properties described referring to any one of these embodiments can generally also be applied or transferred to the other embodiments.

In the embodiments shown in the figures the activator is affixed to the valve head in such a way, that for an activation of the valve the activator is rotated in a plane, i.e. rotated without movement in axial direction. However, the valve can also be designed such that the activator is screwed, i.e. rotated with simultaneous movement in axial direction. The solution where the activator is rotated in a plane has the advantage that it is easier to construct, since a rim is simpler than a thread. Further, the shape and in particular the inner and outer dimensions of the valve are, apart from the removal of sealing bands, not changed by the activation. Finally there is not the problem that the activator might fall off if the user keeps turning even though the activation is already done. The solution where the activator is screwed has the advantage that the activation can be seen, even if there are no sealing-bands. However, this doesn't mean that the container is tamperproof, since depending on the design the activator may be screwed back into its original position.

In the embodiments shown in the figures the break-away element is a twist-off pin with a substantially cylindrical shape connected to the valve-head by a circular predetermined breaking line. However, the break-away element may also have an other shape, for example the shape of a bar or cuboid.

In the embodiments shown in the figures the valve is used as a dispensing-head for a container. However, the valve can also be used to connect two compartments of a container. Initially these two compartments are separate. An activation of the valve creates a passage between the two components. A container of this kind can in particular be used for holding a product which initially consists of two components which are not to be mixed until shortly before its use. Products of this kind are for example certain hair tinting lotions or certain plasters.

The term "break" such as in "break-away" or "break-open" in this document is to be interpreted in a broad, not limiting manner. In particular other ways of disconnecting an element for creating an opening, such as "ripping" or "tearing" are to be understood as being special ways of "breaking".

While there are shown and described presently preferred embodiments of the invention, it is to be distinctly understood that the invention is not limited thereto but may be otherwise variously embodied and practiced within the scope of the following claims.

The invention claimed is:

1. A break-open valve for a container comprising a valve head, a break-away element and an activator, wherein the activator is affixed to the valve head in a rotatable way, wherein the activator engages the break-away element such that a rotation of the activator breaks away the break-away element thereby creating an opening in the valve head, wherein the activator is arranged and designed such that contents passing the valve pass through the activator, characterized in that the activator comprises a wall element and a socket element, wherein the socket element has substantially the shape of a disk affixed inside the wall element and comprises a socket which engages with the break-away element.

2. A break-open valve for a container comprising a valve head, a break-away element and an activator, wherein the activator is affixed to the valve head in a rotatable way, wherein the activator engages the break-away element such that a rotation of the activator breaks away the break-away element thereby creating an opening in the valve head, wherein the activator is arranged and designed such that contents passing the valve pass through the activator, characterized in that the activator comprises a wall element and a socket element, wherein the socket element is inserted in the wall element, and comprises a socket which engages with the break-away element, and further characterized in that said socket element is harder than said wall element.

3. The break-open valve according to claim 2, wherein the socket element has a diameter which is at least twice as large as the diameter of the socket.

4. The break-open valve according to claim 1, wherein the socket element engages with its edge the inside of the wall element such that a momentum for activation of the valve can be transmitted, the edge of the socket element comprising a knurling therefore.

5. The break-open valve for a container, according to claim 1, wherein the activator comprises at least one passage which allows contents to pass through the activator without passing through the socket.

6. The break-open valve according to claim 5, wherein the passage is formed by an opening located in the same socket element as the socket.

7. A break-open valve for a container, comprising a valve head, a break-away element and an activator which comprises a wall member rotatively affixed to the valve head, and a socket element in said wall member wherein the activator engages the break-away element such that a rotation of the activator breaks away the break-away element thereby creating an opening in the valve head and the activator is arranged and designed such that contents passing the valve pass through the activator, wherein a spout through which the contents are dispensed is arranged at the distal end of the activator and wherein the activator comprises a membrane, which is arranged inside said wall element, between said spout and said socket element and which is substantially as large as the inner dimension of the wall element, such that contents passing through the opening in the valve head must pass through the membrane before leaving the activator through said spout.

8. The break-open valve according to claim 7, wherein a hollow space, which is formed by the activator between the membrane and said spout and through which contents must pass during dispensing, has a volume of less than 0.1 ml.

9. A break-open valve for a container comprising a valve head, a break-away element and an activator, wherein the activator is affixed to the valve head in a rotatable way, wherein the activator engages the break-away element such that a rotation of the activator breaks away the break-away element thereby creating an opening in the valve head, wherein the activator is arranged and designed such that contents passing the valve pass through the activator, wherein the activator comprises a membrane, which is arranged such that contents passing through the opening in the valve head must pass through the membrane before leaving the activator through a spout at a distal end thereof, wherein the activator comprises a first component and a second component, wherein the first component is affixed to the valve head and the second component is affixed to the first component and wherein the membrane is held between said two components.

10. The break-open valve according to claim 9, wherein the first component contacts the membrane by radial bars and/or the second component contacts the membrane by a surface comprising radial and annular notches.

11. The break-open valve according to claim 7, wherein the membrane is semi-permeable and/or hydrophobic and/or antibacterial.

12. The break-open valve according to claim 1, wherein there is a substantially circular predetermined breaking line between the break-away element of the valve head, which predetermined breaking line is broken when rotating said activator with respect to the valve head.

13. The break-open valve according to claim 1, wherein the break-away element is a substantially cylindrical pin with an axial knurling.

14. A break-open valve according to claim 1, wherein the break-away element is at least partially counter-sunk in respect to the valve head.

15. The break-open valve according to claim 1, wherein the valve head comprises a substantially cylindrical or conic outer surface which rotatably engages with an inner surface of the activator.

16. The break-open valve according to claim 1, wherein the activator is held on the valve head by snap-on means which are designed such that a snapping-on requires less force than a snapping-off.

17. The break-open valve according to claim 1, wherein the activator comprises a sealing-band, wherein the sealing band is designed such that a rotation of the activator is only possible by or after breaking at least partially away the sealing band.

18. The break-open valve according to claim 1, wherein the activator comprises a spout and the valve head is part of a container or is designed to be affixed to a container such that the break-open valve is installed as or can be used as a dispensing head for said container.

19. The break-open valve according to claim 18, wherein the activator comprises a cannula, which is a cannula for rectal ointments with lateral openings or a cannula for drop dispensing with an inner diameter increasing towards the spout.

20. The break-open valve according to claim 1, wherein said valve comprises a cap for closing the valve over a spout provided at the distal end of the activator for dispensing contents passing therethrough.

21. The break-open valve according to claim 20, wherein the cap comprises a sealing-band which has to be broken away at least partially when removing the cap for the first time.

22. A container comprising a break-open valve according to claim 1.

23. The container according to claim 22, wherein said container is a tube or a flexible bottle.

24. A container comprising a break-open valve according to claim 7.

25. A break-open valve for a container comprising a valve head, a break-away element and an activator, comprising a wall member affixed to the valve head in a rotatable way, and a socket element with a socket which engages the break-away element such that a rotation of the activator breaks away the break-away element from said valve head thereby creating an opening in the valve head, wherein the activator is arranged and designed such that contents passing the valve pass through the activator, and through a semi permeable membrane which has substantially the same diameter as the inside diameter of said wall element, and wherein the break-away element and the socket have matching axial knurlings.

26. The break-open valve according to claim 8 wherein said hollow space has a volume of less than 0.05 ml.

27. The break-open valve according to claim 8 wherein said hollow space has a volume of less than 0.05 ml.

* * * * *

UNITED STATES PATENT AND TRADEMARK OFFICE

CERTIFICATE OF CORRECTION

PATENT NO. : 8,397,927 B2
APPLICATION NO. : 12/064437
DATED : March 19, 2013
INVENTOR(S) : Daniel Krebs It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1334 days.

Signed and Sealed this
First Day of September, 2015

Michelle K. Lee

Michelle K. Lee
*Director of the United States Patent and Trademark Office*